US005595006A

United States Patent [19]

Perrissoud et al.

[11] Patent Number: 5,595,006

[45] Date of Patent: Jan. 21, 1997

[54] REINFORCED SKI BOOT

[75] Inventors: Claude Perrissoud, Saint-Jorioz; René Borel, Annecy, both of France

[73] Assignee: Salomon S.A., Metz-Tessy, France

[21] Appl. No.: 614,906

[22] Filed: Mar. 13, 1996

Related U.S. Application Data

[63] Continuation of Ser. No. 368,635, Jan. 4, 1995, abandoned.

[30] Foreign Application Priority Data

Jan. 12, 1994 [FR] France ..... 94 00401

[51] Int. Cl.[6] ..... A43B 5/04

[52] U.S. Cl. ..... 36/117.5; 36/117.6

[58] Field of Search ..... 36/88, 89, 91, 36/68, 69, 117.5, 117.6, 118.2

[56] References Cited

U.S. PATENT DOCUMENTS

| | | | |
|---|---|---|---|
| 260,069 | 6/1882 | Wallace | 36/89 |
| 757,816 | 4/1904 | Krieger | 36/89 |
| 2,972,822 | 2/1961 | Tanner | 36/89 |
| 3,522,668 | 8/1970 | Fesl | 36/89 X |
| 3,597,862 | 8/1971 | Vogel | 36/2.5 |
| 3,618,946 | 11/1971 | Lee et al. | 273/55 B |
| 3,807,062 | 4/1974 | Spier | 36/2.5 AL |
| 4,461,103 | 7/1984 | Annovi | 36/121 |
| 4,670,999 | 6/1987 | Olivieri | 36/119 |
| 4,791,736 | 12/1988 | Phillips | 36/117 |
| 4,800,659 | 1/1989 | Marega | 36/119 |
| 4,920,666 | 5/1990 | Marega | 36/10 X |
| 5,129,166 | 7/1992 | Montfort et al. | 36/117 |
| 5,189,815 | 3/1993 | Pozzobon et al. | 36/117 |

FOREIGN PATENT DOCUMENTS

| | | | |
|---|---|---|---|
| 0240619 | 10/1987 | European Pat. Off. | 36/117 |
| 0484845 | 5/1992 | European Pat. Off. | A43B 5/04 |
| 1395865 | 12/1965 | France . | |
| 2022109 | 10/1971 | France | A43B 5/00 |
| 2649594 | 1/1991 | France | A43B 5/04 |
| WO88/10076 | 12/1988 | WIPO | A43B 5/04 |

*Primary Examiner*—Ted Kavanaugh

*Attorney, Agent, or Firm*— Greenblum & Bernstein, P.L.C.

[57] ABSTRACT

The invention is related to an alpine ski boot having a rigid shell whose base has an external sole on which a shell base is mounted, which shell base is overlaid by an upper having a rear portion and a front portion. The shell includes an internal sole on its bottom and also receives an internal cushioning including a flexible and comfortable liner, interposed between the foot and the lower part of the leg of the skier and the rigid shell. The rigid internal reinforcement has an asymmetrical transverse section and is of an overall squared shape. In particular, it includes a substantially vertical area extending laterally on the side of the shell base turned inward corresponding to the internal malleolus of the foot of the skier, and extended by a horizontal area extending on its bottom so that the shell base is rendered non-deformable in these areas exclusively, in order to provide firm support during vertical pressures on the sole and/or lateral pressures on the internal side, resulting from the forces exerted by the skier on the boot and its upper during skiing, without at all changing the flexibility characteristics to the other areas.

22 Claims, 3 Drawing Sheets

REINFORCED SKI BOOT

This application is a continuation of application Ser. No. 08/368,635, filed Jan. 4, 1995, now abandoned.

BACKGROUND OF THE INVENTION

1. Field of the Invention

The present invention is related to an alpine ski boot having a rigid shell, provided with an external sole at its base, and in which a portion forming the shell base is overlaid with an upper having a rear portion, or rear spoiler, and a front portion, or front cuff, provided in one or more pieces and journaled with respect to the shell base about at least one transverse journal axis, the shell including an internal sole on its bottom and also receiving internal cushioning in the form of a flexible comfort liner, interposed between the foot and the lower part of the leg, and the rigid shell.

2. Discussion of Background and Material Information

For the above-mentioned type of boot, it is known to provide local reinforcements corresponding to predetermined areas of the foot or of the lower part of the leg so as to modify the rigidity of the boot at right angles with these areas.

For example, in French Patent Publication No. 2,649,594, a boot is known in which an attempt was made to control the forces exerted laterally on the upper, because it was observed that these forces are especially substantial as the skier often takes support on the running edges of the skis.

It is also observed in that French publication, that the manner in which the lateral forces exerted by the leg on the upper of the boot are transmitted to the ski, plays a very important role in the steering of the skis. It is also taught that the collar-shaped uppers of the boots are relatively flexible, and that this flexibility often impedes a precise and instantaneous transmission of the lateral forces from the leg to the ski.

If these observations as well as the problems posed are realistic and concrete, it remains true that the solution proposed, which includes the provision of a side of the upper corresponding to the inner side of the leg with an internal reinforcement, is only a partial solution to the problem.

Indeed, the force thus transmitted by means of the lateral reinforcement of the upper is not directly communicated to the foot, because between the reinforced portion of the upper and the sole of the boot there is an area, in this case consisting of the shell base, that remains relatively flexible. This constitutes an interruption of the progression of the communication, which renders practically useless the presence of the reinforcement in this area.

In addition, if the lateral forces are substantial during skiing, the forces directed in the longitudinal direction of the boot are also substantial when gliding, particularly in the case of forward flexion or rear support, and generate a substantial increase in the vertical pressures on the sole. The above-mentioned solution does not teach anything in this respect.

In French Patent Publication No. 1,395,865 it is also known to reinforce a ski boot by means of a reinforcement element located at the rear level of the heel and extending beneath the latter. This reinforcement also includes two lateral fastening hooks affixed to the upper portion of the boot upper.

This publication does not disclose the modification of the rigidity of the boot in a transverse direction near its sole, which is the seat of all the forces during lateral supports of the ski.

The same is true for the boot described in U.S. Pat. No. 3,618,946, also including a reinforcement at the level of the heel and extended by a sole, without treating the problem of the lateral forces to be transmitted in a positive manner to the ski. In fact, it relates to a soccer shoe that must remain flexible all over in order to allow the foot to flex properly during use of the shoe.

French Patent Publication No. 2,022,109 also describes a ski boot with a reinforced area, but this area only concerns the upper peripheral portion of the upper and does not in any way change the manner of transmitting the lateral forces in the lower portion concerned of the boot.

SUMMARY OF THE INVENTION

An object of the present invention is to overcome the aforementioned disadvantages by providing the skier's foot, when the boot is in a closed position, with a means of having localized and instantaneous lateral internal support, i.e., support that cannot be deferred in time by the possible deformation of the boot, because of the relative flexibility of the material of the shell base of the latter, as it is this shell base that is the seat of the lateral forces and of the vertical pressures to be transmitted to the ski.

Of course one could consider using a material for the shell base that is of a higher quality and more rigid, but this would not only increase its price, but in addition, certain areas of the shell base would have to retain characteristics of flexibility, in order to enable, for example, the tightening on the foot during closure of the boot, and in general, the adaptability of its fitting volume, to the foot of the skier.

One could have also thought to envision a boot made by molding two materials of different rigidities adapted to the areas of the boot, but this leads to the creation of a relatively complicated mold of the shell base.

Given all these considerations, the invention relates to a boot of the above-mentioned type in which an internal rigid reinforcement with an asymmetrical transverse section is provided, of an overall square shape, interposed between the liner and the shell base and including a substantially vertical area extending laterally along the side of the shell base facing inwardly, corresponding to the inner malleolus of the skier's foot, and extended by a horizontal area extending on its bottom, in such a way that the shell base is rendered non-deformable in these areas exclusively, in order to provide firm support during vertical pressures on the sole and/or lateral pressures on the internal side, exerted by the skier, while skiing, without at all changing the flexibility characteristics specific to the other areas.

In this way, the advantages obtained are innumerable, because not only are the above-mentioned problems resolved, but in addition, as concerns a removable piece, one can provide an interchangeability of the reinforcement as a function of the different technical characteristics to be given to the boot, starting from the same shell base and a same upper, depending on, for example, whether it is competitive skiing or recreational skiing and also depending on the level of the skier.

One could also provide, from the same standard base structure, variable fitting volumes as a function of the shape of the foot of the skier, which can be relatively narrow or relatively wide, or even as a function of the weight of the skier.

BRIEF DESCRIPTION OF THE DRAWINGS

Other characteristics and advantages of the invention will become apparent from the description that follows with reference to the annexed drawings that are provided only as non-limiting examples thereof.

DETAILED DESCRIPTION OF THE PREFERRED EMBODIMENTS

Figure 1:
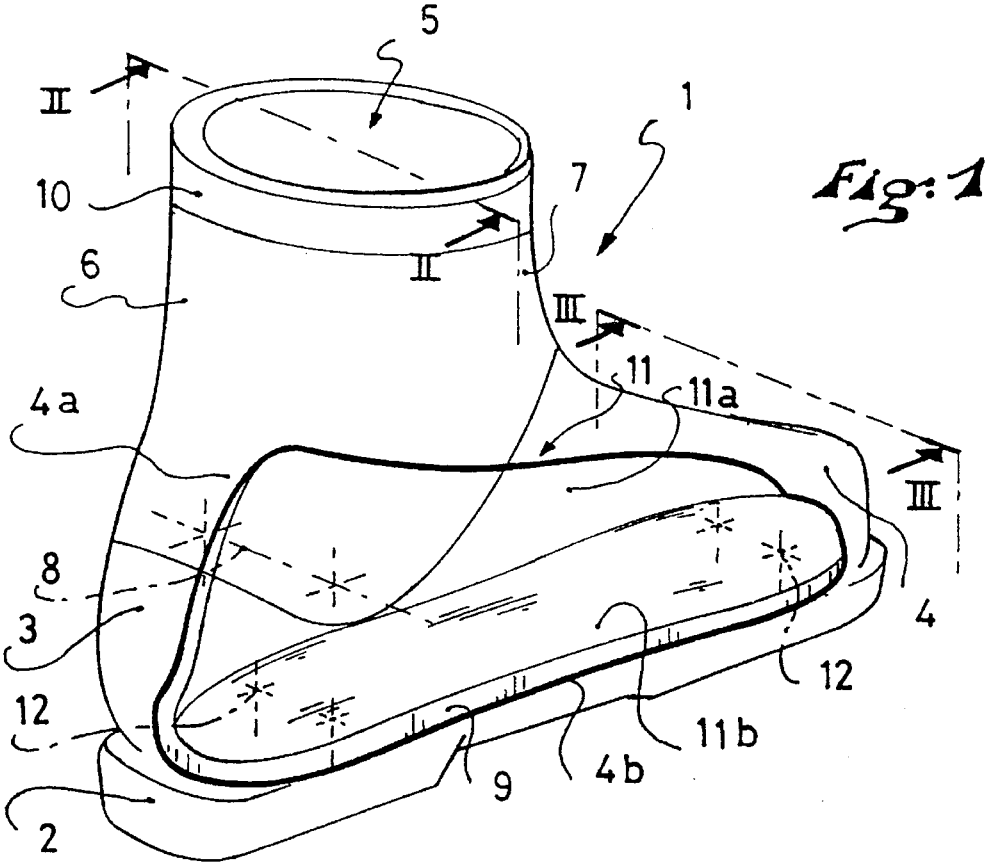
FIG. 1 is a perspective view, partially cut-away, showing a boot provided with an attached rigid reinforcement, according to the invention.

FIG. 1 illustrates an alpine ski boot 1 provided with an external sole 2 on which a rigid shell 3 is mounted. This rigid shell 3 has a shell base 4 overlaid with an upper 5 including a rear portion or rear spoiler 6 and a front portion or front cuff 7, provided in one or more pieces and journaled with respect to the shell base 4 about at least one transverse journal axis 8, the shell 3 including an internal sole 9 attached to its bottom and also receiving an internal cushioning constituted by a flexible and comfortable liner 10, interposed between the foot and the lower part of the leg, and the rigid shell 3.

Figure 2:
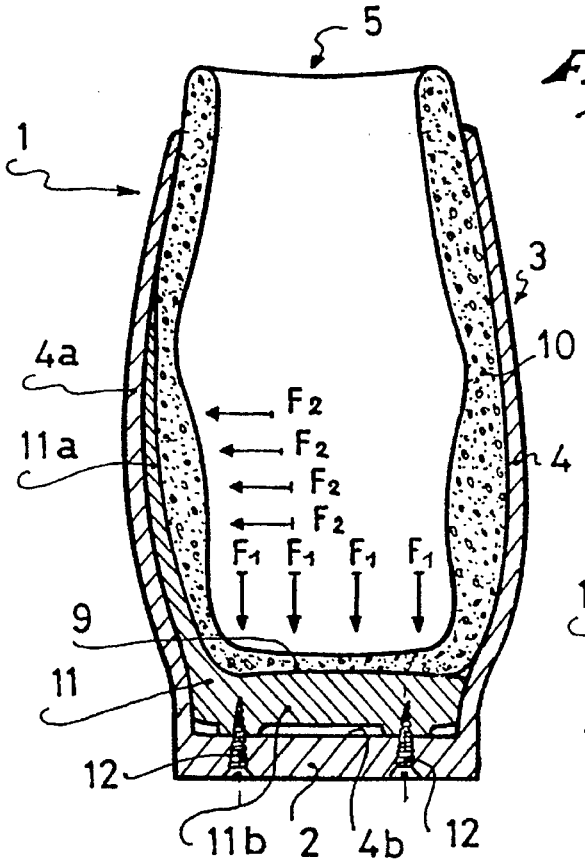
FIGS. 2 and 3 are end elevational views, in transverse section, taken along lines II—II and III—III of FIG. 1, respectively.
Figure 3:
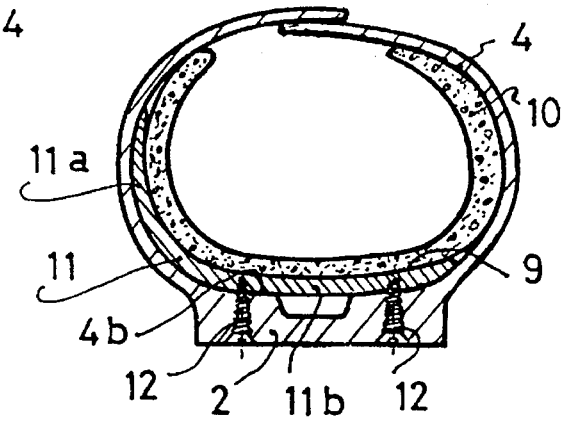

According to the first embodiment of the invention shown in FIGS. 1–3, the boot 1 includes a rigid internal reinforcement 11. This reinforcement 11, having an asymmetrical transverse section of an overall square shape, is interposed between the liner 10 and the shell base 4 and includes a substantially vertical area 11*a* extending laterally along the side 4*a* of the shell base 4 facing inwardly and corresponding to the internal malleolus of the foot of the skier, and extended by a horizontal area 11*b* extending on its bottom 4*b*, so that the shell base 4 is rendered non-deformable in these areas exclusively. To this end, the rigid internal reinforcement 11 is attached and immobilized in the shell base 4 by means of mechanical connection means 12 intervening between the exterior sole 2 and the horizontal area 11*b* of the reinforcement 11, advantageously consisting of the internal sole 9 of the boot 1. Fixed in this way, the rigid internal reinforcement 11 provides firm and instantaneous support during vertical pressures F1 on the sole 9 and/or lateral pressures F2 on the internal side 4*a*, resulting from forces exerted by the skier on the boot and its upper while skiing, without at all changing the flexibility characteristics specific to the other areas.

In the embodiment of FIGS. 1–3, the rigid internal reinforcement 11 is made of a single piece, i.e., it is a unitary member. Further, the linking means 12 are screws but they could also of course take the form of any other means such as clips, rivets or even adhesive means.

Figure 4:
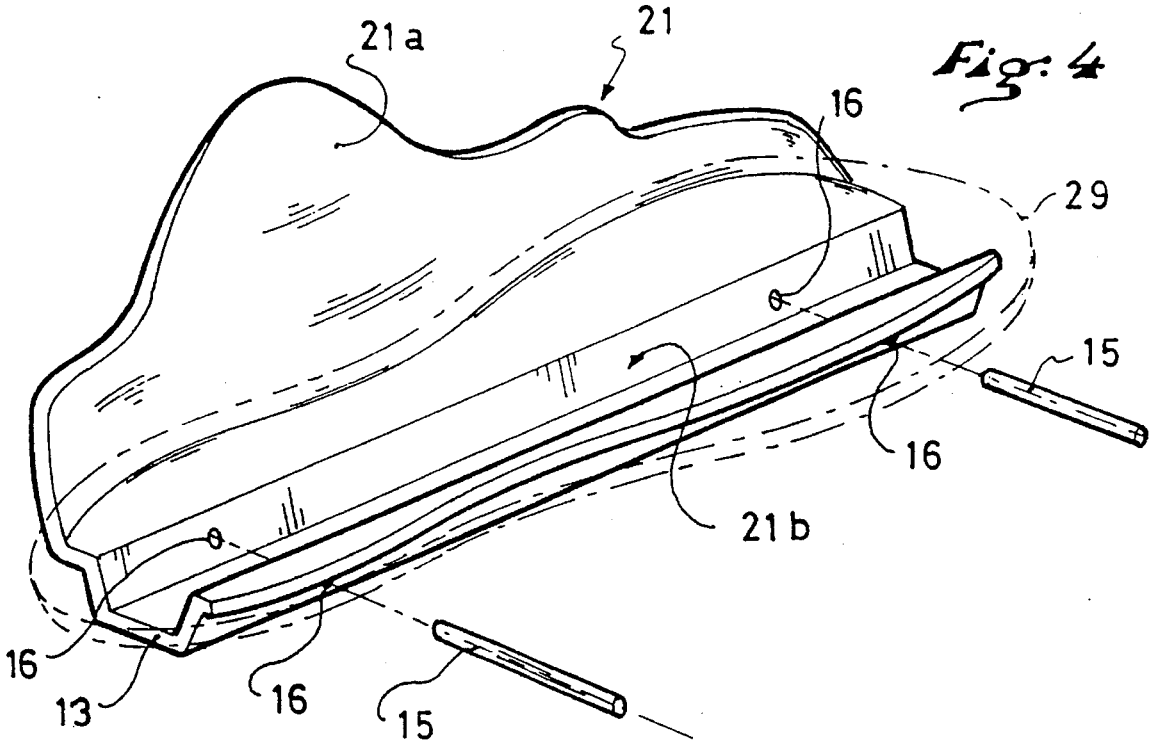
FIG. 4 is a perspective view of a variation of an embodiment of the reinforcement according to the invention.
Figure 5:
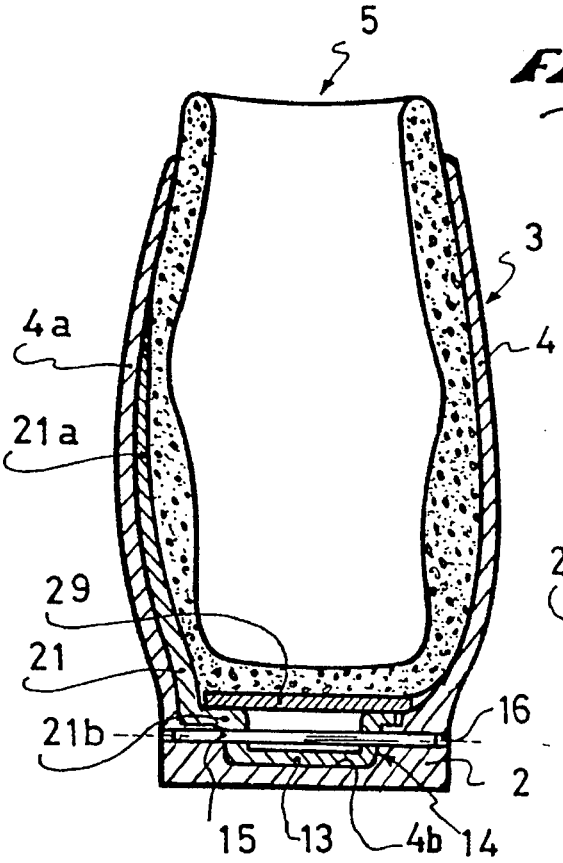
FIGS. 5 and 6 are end elevational views, in transverse section, in the area of the upper and in the area of the front end of the shell, respectively, of a boot equipped with a reinforcement according to FIG. 4.
Figure 6:
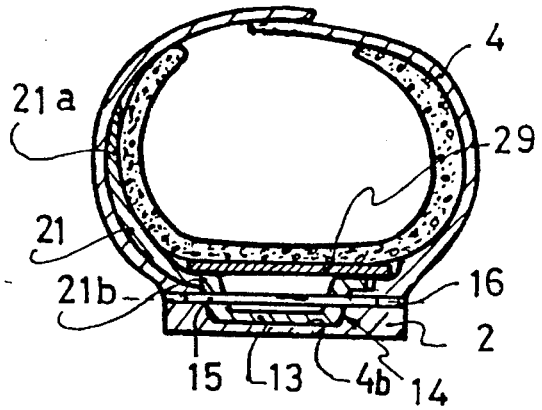

The embodiment of the rigid internal reinforcement 21 shown in FIGS. 4, 5 and 6 repeats all the characteristics defining the previous rigid reinforcement 11 with the exception of the area of the latter that extends on the horizontal bottom 4*b* of the shell base 4. According to this construction, the horizontal area 21*b* of the rigid internal reinforcement 21 is formed so as to define a hollow longitudinal beam 13 of an overall open U-shape, arranged to be housed in an axial groove 14 of a corresponding form arranged in the bottom of the shell base 4, so as to provide the reinforcement 21 with an increased rigidity, an internal sole 29 being attached on the horizontal area 21*b* of the reinforcement 21. That is, unlike the embodiment of FIGS. 1–3 in which the internal sole 9 is formed as a part of the rigid internal reinforcement 11, the embodiment of FIGS. 4–6 includes an internal sole 29 that is formed as a separate member from the rigid internal reinforcement 21.

In this case, the mechanical linkage of the horizontal area 21*b* of the rigid internal reinforcement 21 is provided by means of at least one pin 15 simultaneously traversing in a transverse manner the exterior sole 2 and the hollow beam 13 of the reinforcement 21, by means of corresponding openings 16. In this case, there are two pins 15.

Figure 7:
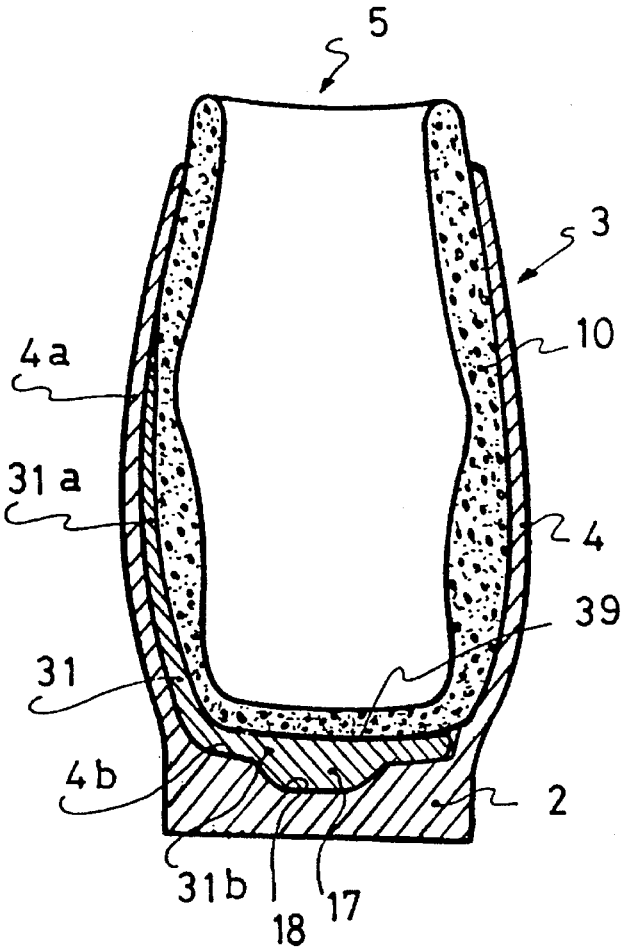
FIGS. 7 and 8 are end elevational views, in transverse section, in the area of the upper and in the area of the front end of the shell, respectively, of a boot equipped with a reinforcement according to a variation of the invention.
Figure 8:
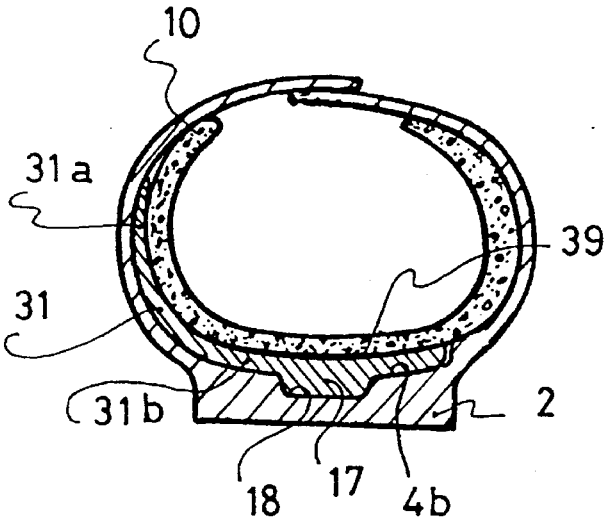

In the embodiment shown in FIGS. 7 and 8, reinforcement 31 repeats all the characteristics defining the rigid reinforcement 11 of FIGS. 1–3 with the exception of the horizontal area of the latter that extends on the bottom 4*b* of the shell base 4. In the present embodiment, the horizontal area 31*b* of the rigid internal reinforcement 31 is sectioned so as to define a solid longitudinal beam 17 of an overall U-shape, arranged to be housed in an axial groove 18 of a corresponding form arranged in the bottom 4*b* of the shell base 4, so as to provide the reinforcement 31 with an increased rigidity. Horizontal area 31*b* is affixed to the bottom 4*b* of the shell base 4 by any known mechanical connection means such as disclosed in the previous figures for example, and advantageously includes an integrated internal sole 39.

Preferably, the internal rigid reinforcements 11, 21, 31, described above, are obtained by injection molding of a thermoplastic material containing fibers, but could also be obtained by any other material.

Also, reinforcements 11, 21, and 31 are preferably linked to the shell base 4 by removable attaching means so as to render them interchangeable or adaptable depending on the shape of the foot of the skier and/or the technical characteristics to be conferred to the boot.

In any case and regardless of the embodiment chosen, according to the object, the invention enables improvement of the lateral transmission at the level of the shell base, while maintaining deformable areas for the overall envelopment of the foot, particularly on the external side and the upper front portion of the shell base, these deformations being controlled exclusively at the level of the sole and of the internal side of the shell base.

The instant application is based upon French patent application 94.00401 of Jan. 12, 1994, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed:

1. A ski boot comprising:

an external sole;

a rigid shell having a shell base mounted upon said external sole, said shell base having an internally facing side and an externally facing side;

an upper mounted for movement upon said shell base about a transverse journal axis, said upper including a front portion and a rear portion;

internal cushioning in the form of a flexible liner positioned between said rigid shell and at least in the area between the foot and a lower portion of the leg of a skier of the boot;

a rigid internal reinforcement having an asymmetrical transverse cross section and a generally squared shape, said rigid internal reinforcement being interposed between said flexible liner and said shell base; and said rigid internal reinforcement including a generally horizontal bottom area and a substantially vertical area at said internally facing side of said shell base, said horizontal area and said vertical area being rigidly affixed together laterally and longitudinally;

whereby said horizontal bottom area and said vertical area comprise means for rendering said shell base non-deformable exclusively in said horizontal bottom area and said vertical internally facing side for providing firm support during vertical pressure on said internal sole and/or lateral pressure on said internally facing side of said shell base exerted by the skier during skiing without changing flexibility characteristics of areas of said shell base other than said horizontal bottom area and said vertical area.

2. A ski boot according to claim 1, wherein:

said rigid internal reinforcement is attached to and immobilized with respect to said shell base by means of mechanical connection means extending between said external sole and said generally horizontal bottom area of said rigid internal reinforcement.

3. A ski boot according to claim 1, wherein:

said rigid shell includes a bottom having a longitudinally extending groove;

said generally horizontal bottom area of said rigid internal reinforcement defines a hollow longitudinally extending beam having an upwardly open U-shaped bottom in transverse cross section, said U-shaped bottom of said rigid internal reinforcement being housed in said longitudinally extending groove of said bottom of said rigid shell for increasing rigidity of said rigid internal reinforcement; and said ski boot further comprising an internal sole attached to said generally horizontal bottom area of said rigid internal reinforcement.

4. A ski boot according to claim 3, wherein:

said mechanical connection means extending between said external sole and said generally horizontal bottom area of said rigid internal reinforcement comprises at least one transversely extending pin positioned within respective openings in said external sole and said generally horizontal bottom area of said rigid internal reinforcement.

5. A ski boot according to claim 1, wherein:

said rigid shell includes a bottom having a longitudinally extending groove;

said generally horizontal bottom area of said rigid internal reinforcement defines a solid longitudinally extending beam having a U-shaped bottom in transverse cross section, said U-shaped bottom of said rigid internal reinforcement being housed in said longitudinally extending groove of said bottom of said rigid shell for increasing rigidity of said rigid internal reinforcement; and said generally horizontal bottom area of said rigid internal reinforcement is affixed to said bottom of said rigid shell by a mechanical connection, said generally horizontal bottom area of said rigid internal reinforcement further comprising a unitarily formed internal sole.

6. A ski boot according to claim 1, wherein:

said rigid internal reinforcement is injection molded from a thermal plastic material containing fibers.

7. A ski boot according to claim 1, wherein:

said rigid internal reinforcement is connected to said shell base by means of removable attachment means for interchanging said rigid internal reinforcement according to the shape of the foot of the skier.

8. A ski boot according to claim 1, wherein:

the foot of the skier has an internal malleolus portion and said substantially vertical area of said rigid internal reinforcement covers said internal malleolus portion.

9. A ski boot according to claim 1, wherein:

said front portion and said rear portion of said upper are formed as a unitary piece.

10. A ski boot according to claim 1, wherein:

said front portion of said upper is formed as a piece distinct from said rear portion of said upper.

11. A ski boot according to claim 1, wherein:

said bottom area extends longitudinally above said external sole to form a rigid internal sole for the ski boot.

12. A ski boot according to claim 1, wherein:

an internal sole, separate from said internal reinforcement, positioned upon a bottom of said rigid shell.

13. A ski boot according to claim 1, wherein:

said rigid internal reinforcement is comprised of a single piece.

14. A ski boot according to claim 1, wherein:

said rigid internal reinforcement includes no portion covering a malleolus of the foot of the skier at an externally facing side of said shell base.

15. A ski boot comprising:

an external sole;

a rigid shell having a shell base mounted upon said external sole, said shell base having an internally facing side and an externally facing side;

an upper mounted upon and extending upwardly from said shell base;

flexible cushioning liner positioned between said rigid shell and at least in the area between the foot and a lower portion of the leg of a skier of the boot;

a rigid internal reinforcement having an asymmetrical transverse cross section interposed between said flexible cushioning liner and said shell base, said rigid internal reinforcement including a generally horizontal bottom portion and a substantially vertical portion, said generally bottom portion and said substantially vertical portion being formed as a unitary member, said substantially vertical portion covering a malleolus of the foot of the skier only at said internally facing side of said shell base and not covering a malleolus of the foot of the skier at said externally facing side of said shell base.

16. A ski boot according to claim 15, wherein:

said generally bottom portion and said substantially vertical portion of said rigid internal reinforcement are one piece.

17. A ski boot according to claim 15, wherein:

said rigid internal reinforcement includes no portion covering a malleolus of the foot of the skier at an externally facing side of said shell base.

18. A ski boot comprising:

an external longitudinally extending sole;

a rigid shell having a shell base mounted upon said external sole, said shell base having an internally facing side and an externally facing side;

an upper mounted for movement upon said shell base about a transverse journal axis, said upper including a front portion and a rear portion;

internal cushioning in the form of a flexible liner positioned between said rigid shell and at least in the area between the foot and a lower portion of the leg of a skier of the boot;

a rigid internal reinforcement having an asymmetrical transverse cross section and a generally squared shape, said rigid internal reinforcement being interposed between said flexible liner and said shell base; and said rigid internal reinforcement including a generally horizontal bottom area and a substantially vertical area at said internally facing side of said shell base, said bottom area extending above and along substantially the entire length of said external sole, said rigid internal reinforcement is comprised of a single piece;

whereby said horizontal bottom area and said vertical area comprise means for rendering said shell base non-deformable exclusively in said horizontal bottom area and said vertical internally facing side for providing firm support during vertical pressure on said internal sole and/or lateral pressure on said internally facing side of said shell base exerted by the skier during skiing without changing flexibility characteristics of areas of said shell base other than said horizontal bottom area and said vertical area.

19. A ski boot according to claim 18, wherein:

said rigid internal reinforcement is a unitary member.

20. A ski boot according to claim 18, wherein:

said horizontal bottom area of said internal reinforcement forms an internal sole for the ski boot.

21. A ski boot according to claim 18, further comprising:

an internal sole, separate from said internal reinforcement, positioned upon a bottom of said rigid shell.

22. A ski boot according to claim 18, wherein: said rigid internal reinforcement includes no portion covering a malleolus of the foot of the skier at an externally facing side of said shell base.

* * * * *